US008210019B2

(12) United States Patent
Ueda et al.

(10) Patent No.: US 8,210,019 B2
(45) Date of Patent: Jul. 3, 2012

(54) METHOD FOR PRODUCING PEARLITIC RAIL EXCELLENT IN WEAR RESISTANCE AND DUCTILITY

(75) Inventors: Masaharu Ueda, Tokyo (JP); Kazunori Seki, Tokyo (JP); Takuya Sato, Tokyo (JP); Takeshi Yamamoto, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 538 days.

(21) Appl. No.: 12/309,439

(22) PCT Filed: Jul. 24, 2007

(86) PCT No.: PCT/JP2007/064839

§ 371 (c)(1),
(2), (4) Date: Jan. 16, 2009

(87) PCT Pub. No.: WO2008/013300

PCT Pub. Date: Jan. 31, 2008

(65) Prior Publication Data

US 2009/0314049 A1 Dec. 24, 2009

(30) Foreign Application Priority Data

Jul. 24, 2006 (JP) ..... 2006-200860
Jul. 3, 2007 (JP) ..... 2007-174800

(51) Int. Cl.
*B21B 23/00* (2006.01)
*B21D 37/16* (2006.01)

(52) U.S. Cl. ..... 72/364; 72/365.2; 72/342.2

(58) Field of Classification Search ..... 72/200, 72/201, 224, 225; 148/581, 584, 320
See application file for complete search history.

(56) References Cited

U.S. PATENT DOCUMENTS 3,896,653 A * 7/1975 Sakai et al. ..... 72/200
3,897,279 A * 7/1975 Shaughnessy et al. ..... 148/648
4,082,577 A * 4/1978 Heller ..... 148/581

(Continued)

FOREIGN PATENT DOCUMENTS

EP 1 493 831 1/2005

(Continued)

OTHER PUBLICATIONS

"Hot Rolling of Steel," by William L Roberts, copyright 1983 by Marcel Dekker, Inc. 270 Madison Avenue, New York 10016 ISBN 0-8247-1345-1, p. 622 & 623.*

(Continued)

*Primary Examiner* — Edward Tolan
*Assistant Examiner* — Lawrence J Averick
(74) *Attorney, Agent, or Firm* — Kenyon & Kenyon LLP

(57) ABSTRACT

The invention provides a method for producing a pearlitic rail by rough hot rolling and finish hot rolling a billet. In the finish hot rolling, the billet is rolled at a rail head surface temperature in a range of not higher than 900° C. to not lower than the $Ar_3$ transformation point or $Ar_{cm}$ transformation point to produce a head cumulative reduction of area of not less than 20%, where the reaction force ratio of the finish rolling is not less than 1.25. The finish hot rolled rail head surface is subjected to accelerated cooling or spontaneous cooling to a temperature of 550° C. or less at a cooling rate of 2 to 30° C./seconds, thereby refining the rail head structure to attain a hardness within a predetermined range, and improving rail wear resistance and ductility.

2 Claims, 5 Drawing Sheets

U.S. PATENT DOCUMENTS

| | | | | |
|---|---|---|---|---|
| 4,375,995 | A * | 3/1983 | Sugino et al. | 148/584 |
| 4,486,243 | A * | 12/1984 | Lambert et al. | 148/584 |
| 4,615,200 | A * | 10/1986 | Michaux | 72/225 |
| 4,759,806 | A * | 7/1988 | Dambre | 148/596 |
| 4,874,644 | A * | 10/1989 | Fergison | 428/636 |
| 4,886,558 | A * | 12/1989 | Teramoto et al. | 148/581 |
| 5,170,932 | A * | 12/1992 | Blumauer | 228/189 |
| 5,191,778 | A * | 3/1993 | Inagaki et al. | 72/12.2 |
| 5,209,792 | A * | 5/1993 | Besch et al. | 148/581 |
| 5,658,400 | A * | 8/1997 | Uchino et al. | 148/333 |
| 5,762,723 | A * | 6/1998 | Ueda et al. | 148/320 |
| 6,254,696 | B1 * | 7/2001 | Ueda et al. | 148/333 |
| 6,547,897 | B2 * | 4/2003 | Moser et al. | 148/582 |
| 7,217,329 | B2 * | 5/2007 | Cordova | 148/584 |
| 7,288,159 | B2 * | 10/2007 | Cordova | 148/584 |
| RE40,263 | E * | 4/2008 | Ueda et al. | 148/581 |
| RE41,033 | E * | 12/2009 | Ueda et al. | 148/581 |
| RE42,360 | E * | 5/2011 | Ueda et al. | 148/581 |
| 7,972,451 | B2 * | 7/2011 | Ueda et al. | 148/320 |
| RE42,668 | E * | 9/2011 | Ueda et al. | 148/581 |
| 2001/0025674 | A1 | 10/2001 | Prskawetz et al. | |
| 2004/0187981 | A1 * | 9/2004 | Ueda et al. | 148/584 |
| 2007/0181231 | A1 * | 8/2007 | Ueda et al. | 148/584 |
| 2009/0274572 | A1 * | 11/2009 | Honjo et al. | 420/84 |
| 2010/0006189 | A1 * | 1/2010 | Larker | 148/548 |
| 2010/0186857 | A1 * | 7/2010 | Honjo et al. | 148/584 |

FOREIGN PATENT DOCUMENTS

| | | |
|---|---|---|
| JP | 57-198216 | 12/1982 |
| JP | 62-127453 | 6/1987 |
| JP | 7-150235 | 6/1995 |
| JP | 07-173530 | 7/1995 |
| JP | 11-226617 | 8/1999 |
| JP | 2001-234238 | 8/2001 |
| JP | 2002-226915 | 8/2002 |
| JP | 2005-290544 | 10/2005 |
| WO | WO 2005/085481 | 9/2005 |

OTHER PUBLICATIONS

"Hot Rolling of Steel," by William L Roberts, copyright 1983 by Marcel Dekker, Inc. 270 Madison Avenue, New York 10016 ISBN 0-8247-1345-1, p. 621-623 & 632-635.*

International Search Report dated Oct. 16, 2007 issued in corresponding PCT Application No. PCT/JP2007/064839.

European Search Report in European application No. 07791533.8 dated Oct. 25, 2011.

* cited by examiner

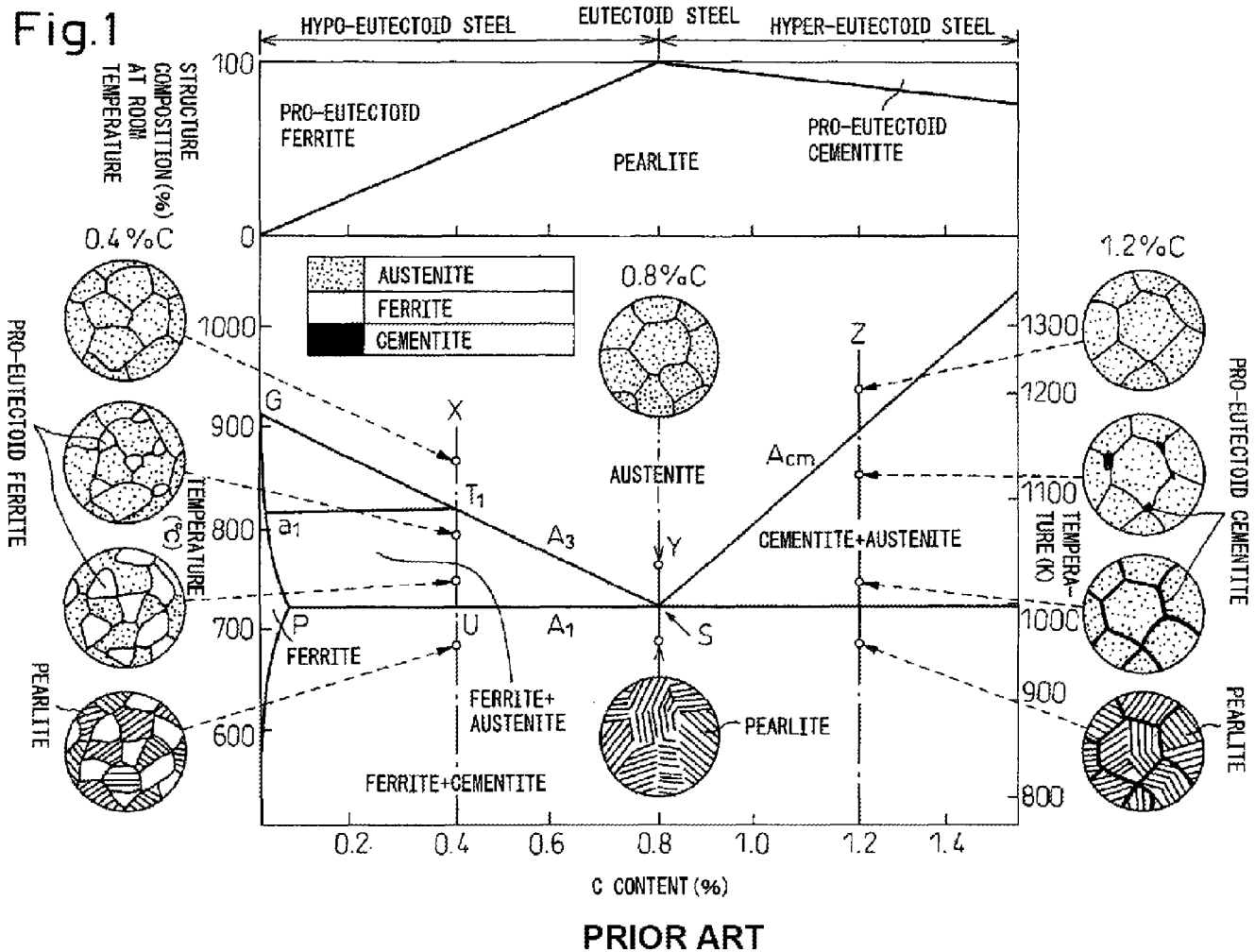
Fig.1
STRUCTURE COMPOSITION (%) AT ROOM TEMPERATURE
HYPO-EUTECTOID STEEL
EUTECTOID STEEL
HYPER-EUTECTOID STEEL
PRO-EUTECTOID FERRITE
PEARLITE
PRO-EUTECTOID CEMENTITE
AUSTENITE
FERRITE
CEMENTITE
0.4%C
0.8%C
1.2%C
PRO-EUTECTOID FERRITE
PEARLITE
PRO-EUTECTOID CEMENTITE
PEARLITE
TEMPERATURE (°C)
TEMPERATURE (K)
C CONTENT (%)
FERRITE+AUSTENITE
FERRITE+CEMENTITE
CEMENTITE+AUSTENITE
FERRITE
PRIOR ART

METHOD FOR PRODUCING PEARLITIC RAIL EXCELLENT IN WEAR RESISTANCE AND DUCTILITY

FIELD OF THE INVENTION

This invention relates to a method for producing a rail for use in heavy haul railways, particularly to a pearlitic rail production method directed to simultaneously improving wear resistance and ductility of the rail head.

DESCRIPTION OF THE RELATED ART

Although high carbon pearlitic steel is used as a railway rail material because of its excellent wear resistance, it is inferior in ductility and toughness owing to very high carbon content.

For example, the ordinary carbon steel rail of a carbon content of 0.6 to 0.7 mass % according to JIS E1101-1990 has a normal temperature impact value by the JIS No. 3 U-notch Charpy test of around 12 to 18 J/cm$^2$. When such a rail is used at low temperature such as in a cold-climate region, it experiences brittle fracture starting from small initial defects and fatigue cracks.

In recent years, moreover, efforts to improve the wear resistance of rail steel by increasing carbon content to still higher levels have led to additional declines in ductility and toughness.

As a general method for improving the ductility and toughness of pearlitic steel it is said to be effective to refine the pearlite structure (pearlite block size), specifically to grain-refine the austenite structure before pearlite transformation and also to refine the pearlite structure.

Methods for grain-refining austenite structure include that of lowering hot rolling temperature or reduction during hot rolling and that of heat treating the hot rolled rail by low-temperature reheating. Methods for refining pearlite structure include that of promoting pearlite transformation from within austenite grains by use of transformation nuclei.

However, the degree to which hot rolling temperature can be lowered and reduction increased during rail production is limited by the need to maintain formability during hot rolling. Thorough refinement of austenite grains is therefore impossible. Further, thorough pearlite structure refinement cannot be achieved by using transformation nuclei to transform pearlite from within the austenite grains, because it is difficult to control the abundance of the transformation nuclei and the transformation of pearlite from within the grains is not stable.

In view of these issues, the method used to achieve fundamental improvement of pearlite-structure rail ductility and toughness is to refine the pearlite structure by low-temperature reheating the hot rolled rail and thereafter induce pearlite transformation by accelerated cooling.

However, when the aforesaid low-temperature reheating heat treatment is applied to the still higher carbon steels developed in recent years with an eye to improving wear resistance, coarse carbides remain inside the austenite grains, giving rise to problems of decreased ductility and/or toughness of the pearlite structure after hot rolling. And since the method uses reheating, it is uneconomical in the points of high production cost and low productivity.

Owing to the foregoing circumstances, a need has been felt for the development of a method for producing a high-carbon steel rail capable of ensuring good formability during hot rolling and enabling refinement of pearlite structure after hot rolling without conducting low-temperature reheating.

The high-carbon steel rail production methods discussed in the following were developed to meet this need. These methods are characterized chiefly in the point of refining pearlite structure by taking advantage of the fact that the austenite grains of a high-carbon steel readily recrystallize at a relatively low temperature and even when the reduction is small. They improve pearlitic steel ductility and/or toughness by using low-reduction continuous hot rolling to obtain uniformly refine grains.

Japanese Unexamined Patent Publication No. H7-173530A teaches a high-ductility rail obtained by, in the course of finish hot rolling a steel rail containing high-carbon steel, conducting three or more passes of continuous hot rolling at a predetermined inter-pass time.

Japanese Unexamined Patent Publication No. 2001-234238A teaches that a high wear resistance and high toughness rail is obtained by, in the course of finish hot rolling a steel rail containing high-carbon steel, conducting two or more passes of continuous hot rolling at a predetermined inter-pass time and after conducting the continuous hot rolling, conducting accelerated cooling following hot rolling.

Japanese Unexamined Patent Publication No. 2002-226915A teaches that a high wear resistance and high toughness rail is obtained by, in the course of finish hot rolling a steel rail containing high-carbon steel, conducting cooling between passes and after conducting the continuous hot rolling, conducting accelerated cooling following hot rolling.

However, depending on the steel carbon content, the temperature at the time of hot rolling during continuous hot rolling, and the combination of hot rolling pass number and inter-pass time, the techniques taught by these patent references cannot achieve refinement of the austenite structure, so that the pearlite structure coarsens to prevent improvement of ductility and toughness.

Another patent reference, Japanese Unexamined Patent Publication No. S62-127453A, teaches production of a rail excellent in ductility and toughness by low-temperature hot rolling a rail steel having a carbon content of 0.90 mass % or less at 800° C. or less.

However, since the only requirement specified by the technique taught by this patent reference is a reduction of area of 10% or greater, reduction is sometimes insufficient, in which case it is difficult to achieve the required toughness and ductility, particularly for a high-carbon (C>0.90%) rail steel whose ductility and toughness are easily diminished and which tends to experience grain growth during hot rolling.

SUMMARY OF THE INVENTION

Against this backdrop, it is desirable to provide a pearlitic rail having improved ductility and excellent wear resistance by achieving stable refinement of pearlite structure.

The present invention was accomplished in light of the foregoing issues and has as its object to improve the head wear resistance and ductility required by a rail for use in a heavy haul railway, simultaneously and consistently.

The gist of the method for producing a pearlitic rail according to this invention lies in controlling head surface rolling temperature, head cumulative reduction and reaction force ratio during finish hot rolling and thereafter conducting appropriate heat treatment to stably improve the ductility and wear resistance of the rail head.

Specifically, stable improvement of rail head ductility is achieved by controlling the amount of unrecrystallized austenite of the head surface immediately after hot rolling, thereby attaining pearlite structure refinement, whereafter good wear resistance is achieved by conducting accelerated cooling.

The invention is constituted as follows:

(A) A method for producing a pearlitic rail excellent in wear resistance and ductility by subjecting to at least rough hot rolling and finish hot rolling a bloom comprising, in mass %, C: 0.65-1.20%, Si: 0.05-2.00%, Mn: 0.05-2.00%, and a remainder of iron an unavoidable impurities, which method comprises:

conducting the finish hot rolling at a rail head surface temperature in a range of not higher than 900° C. to not lower than $Ar_3$ transformation point or $Ar_{cm}$ transformation point to produce a head cumulative reduction of area of not less than 20% and a reaction force ratio, defined as a value obtained by dividing rolling mill reaction force by a rolling mill reaction force at the same cumulative reduction of area and a hot rolling temperature of 950° C., is not less than 1.25; and subjecting the finish hot rolled rail head surface to accelerated cooling or spontaneous cooling to at least 550° C. at a cooling rate of 2 to 30° C./sec.

(B) A method for producing a pearlitic rail excellent in wear resistance and ductility according to (A), wherein the accelerated cooling is started within 150 sec after completion of the finish hot rolling.

BRIEF DESCRIPTION OF THE DRAWINGS

FIG. 1 is an Fe—$Fe_3C$ equilibrium diagram for determining $Ar_3$ and $Ar_{cm}$ (from Tekko Zairyo (Iron and Steel Materials), Japan Institute of Metals).

DETAILED DESCRIPTION OF THE INVENTION

Figure 2:
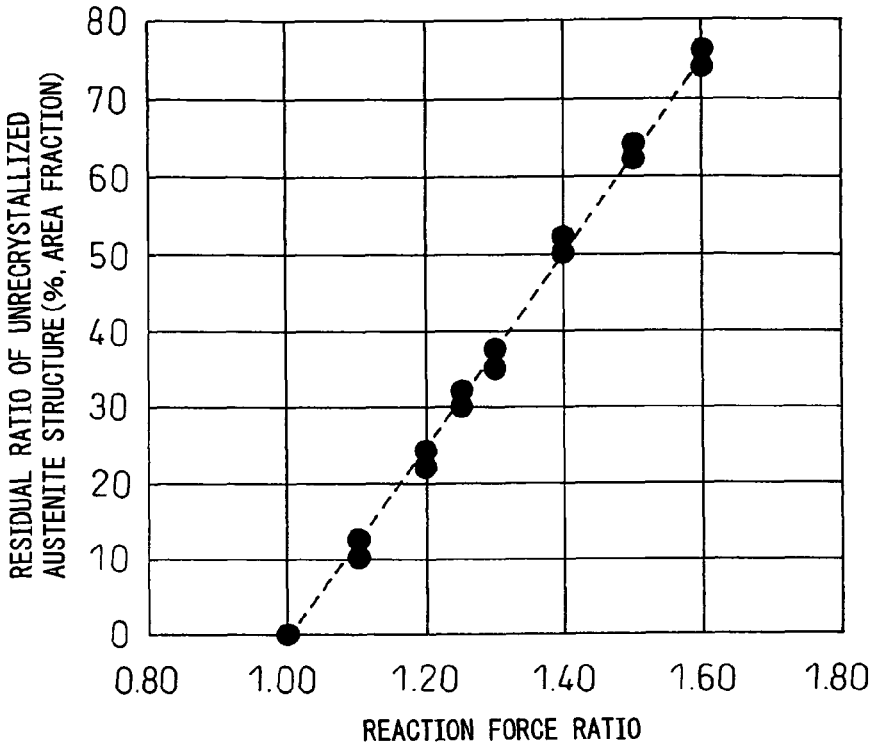
FIG. 2 is a graph based on the results of a hot rolling test conducted using steels having carbon contents of 0.65 to 1.20%, which shows how residual ratio of unrecrystallized austenite structure immediately after hot rolling varied as a function of reaction force ratio (value obtained by dividing rolling mill reaction force by rolling reaction force at the same cumulative reduction of area and a hot rolling temperature of 950° C.).

A method for producing a pearlitic rail excellent in wear resistance and ductility is explained in detail below as an embodiment of the present invention. Unless otherwise indicated, % indicates mass %.

The inventors conducted simulated hot rolling of high-carbon steels of various carbon contents (0.50-1.35%) to observe how austenite grain behavior is related to temperature and reduction of area during hot rolling.

They found that when a steel having a carbon content in the range of 0.65-1.20% is hot rolled at a temperature within the range of not higher than 900° C. and not lower than the $Ar_3$ transformation point or $Ar_{cm}$ transformation point, initial austenite grains do not recrystallize in addition to the fine recrystallized grains of recrystallized initial austenite grains, so that a large amount of residual unrecrystallized austenite grains (flat coarse grains) is observed.

The inventors also conducted an experiment to determine the behavior of unrecrystallized austenite grains after hot rolling. They found that when temperature and reduction of area exceed certain values, unrecrystallized austenite structure recrystallizes fine austenite grains during spontaneous cooling after hot rolling.

The inventors further studied fine austenite grains obtained from the unrecrystallized austenite structure to find a method for stably improving ductility. They conducted laboratory hot rolling and heat-treatment experiments and assessed ductility by tensile testing. They discovered that pearlite structure refinement and stable ductility improvement can be effectively achieved by hot holding the amount of unrecrystallized austenite structure produced immediately after hot rolling to within a certain range.

In addition to the foregoing studies, the inventors conducted an investigation for determining an immediate post-heat treatment method for improving ductility. For this, they conducted laboratory hot rolling and heat treatment experiments. The results were tensile-tested to evaluate ductility. Through this process, it was learned that coarsening of recrystallized austenite grains can be inhibited to markedly improve ductility by conducting not only ordinary spontaneous cooling after completion of hot rolling but also further conducting accelerated cooling within a certain time period after completion of hot rolling.

The inventors then sought a method of further improving ductility by directly utilizing the unrecrystallized austenite structure. For this, they conducted laboratory hot rolling and heat treatment experiments. Ductility was evaluated by tensile-testing. By this, it was ascertained that when the spontaneous cooling time after completion of hot rolling is shortened so that unrecrystallized austenite structure does not recrystallize, and accelerated cooling thereafter is conducted in this state, much fine pearlite structure occurs from within the unrecrystallized austenite structure to raise ductility to a still higher level.

The inventors next looked for a way to control the unrecrystallized austenite structure that generates the fine pearlite structure. By conducting hot rolling experiments and evaluation on steels of carbon content in the range of 0.65 to 1.20%, they discovered that there is a direct correlation between the value obtained by dividing the hot rolling mill reaction force by the rolling reaction force at the same cumulative reduction of area and a hot rolling temperature of 950° C. (herein sometimes called "reaction force ratio") and the amount of unrecrystallized austenite structure occurring immediately after hot rolling. They ascertained that the amount of unrecrystallized austenite structure generated can be controlled by controlling the reaction force ratio.

The foregoing findings led the inventors to the discovery that in the process of producing a rail by hot rolling a high-carbon bloom, excellent ductility and wear resistance of the rail head can be simultaneously achieved by controlling the rail rolling temperature and reaction force ratio during hot rolling to not less than certain values, thereby causing a certain amount of predetermined unrecrystallized austenite structure to remain, and thereafter conducting heat treatment within a certain time period to refine the pearlite structure.

The reasons for the ranges defined by the invention are explained in the following.

(1) Reasons for the Content Ranges Defined for the Chemical Components of the Steel Billet for Rail Rolling C: 0.65 to 1.20%

C promotes pearlite transformation and is an element that effectively works to establish wear resistance. When C content is below 0.65%, the minimum strength and wear resistance required by the rail cannot be maintained. When C content exceeds 1.20%, wear resistance and ductility decline in the case of the invention production method owing to abundant occurrence of coarse pro-eutectoid cementite structure after heat treatment and after spontaneous cooling. C content is therefore defined as 0.65 to 1.20%.

When carbon content is 0.95% or greater, wear resistance improves markedly so that the effect of prolonging rail service life is pronounced. In conventional production methods, high carbon content tends to promote grain growth and thus inhibit ductility. In contrast, the present invention can exploit the merits of high carbon content. Since the invention production method therefore improves ductility in rail steels having a carbon content of 0.95% or greater, which have conventionally been deficient in ductility, it is particularly effective as a method for providing a high-carbon rail excellent in both wear resistance and ductility.

Si: 0.05 to 2.00%

Si is required as a deoxidizer. Si also increases the hardness (strength) of the rail head by solid solution strengthening ferrite phase in the pearlite structure. Moreover, in a hypereutectoid steel, Si inhibits generation of pro-eutectoid cementite structure, thereby inhibiting decline in ductility. When Si content is less than 0.05%, these effects are not thoroughly manifested. When Si content exceeds 2.00%, many surface defects occur during hot rolling and weldability declines owing to generation of oxides. In addition, hardenability markedly increases and martensite structure harmful to rail wear resistance and ductility occurs. Si content is therefore defined as 0.05 to 2.00%.

Mn: 0.05 to 2.00%

Mn ensures pearlite structure hardness and improves wear resistance by increasing hardenability and reducing pearlite lamellar spacing. When Mn content is less than 0.05%, its effect is slight, so that the wear resistance required by the rail cannot be easily attained. When Mn content exceeds 2.00%, hardenability increases markedly and martensite structure harmful to wear resistance and ductility readily occurs. Mn content is therefore defined as 0.05 to 2.00%.

Although this invention does not particularly stipulate the chemical components of the steel bloom for rail hot rolling other than C, Si and Mn, the steel bloom preferably further contains, as required, one or more of Cr: 0.05 to 2.00%, Mo: 0.01 to 0.50%, V: 0.005 to 0.5000%. Nb: 0.002 to 0.050, B: 0.0001 to 0.0050%, Co: 0.003 to 2.00%, Cu: 0.01 to 1.00%, Ni: 0.01-1.00%, Ti: 0.0050-0.0500%, Mg: 0.0005 to 0.0200%, Ca: 0.0005 to 0.0150 to Al: 0.010 to 1.00%, Zr: 0.0001-0.2000%, and N: 0.0060 to 0.0200%

Cr: 0.05 to 2.00%

Cr refines pearlite structure. It therefore contributes to wear resistance improvement by helping to attain high hardness (strength). When Cr content is less than 0.05%, its effect is slight. When Cr content exceeds 2.00%, much martensite structure harmful to wear resistance and ductility occurs. Cr content is therefore preferably 0.05 to 2.00%.

Mo: 0.01 to 0.50%

Mo improves pearlite structure hardness (strength). Namely, it helps to attain high hardness (high strength) by refining pearlite structure. When Mo content is less than 0.01%, its effect is slight. When Mo content exceeds 0.50%, martensite structure harmful to ductility occurs. Mo content is therefore preferably 0.01 to 0.50%.

V: 0.005-0.500%

V forms nitrides and carbonitrides, thereby improving ductility, and also effectively improves hardness (strength). When V is present at a content of less than 0.005%, it cannot be expected to exhibit sufficient effect. When V content exceeds 0.500%, occurrence of coarse precipitants that act as starting points of fatigue damage is observed. V content is therefore preferably 0.005-0.500%.

Nb: 0.002 to 0.050%

Nb forms nitrides and carbonitrides, thereby improving ductility, and also effectively improves hardness (strength). In addition, it stabilizes unrecrystallized austenite structure by raising the austenite unrecrystallization temperature range. Nb is ineffective at a content of less than 0.002%. When Nb content exceeds 0.050%, occurrence of coarse precipitants that act as starting points of fatigue damage is observed. Nb content is therefore preferably 0.002-0.050%.

B: 0.0001 to 0.0050%

B uniformizes rail head hardness distribution by refining generated pro-eutectoid cementite. It therefore prevents decline in ductility and prolongs service life of the rail. When B content is less than 0.0001%, its effect is inadequate. When B content exceeds 0.0050%, coarse precipitates occur. B content is therefore preferably 0.0001 to 0.0050%.

Co: 0.003 to 2.00%

Co improves pearlite structure hardness (strength). It also further refines the fine lamellae of the pearlite structure formed immediately under the rolling surface by contact of wheels with the rail head wear surface, thereby improving wear resistance. Co is ineffective at a content of less than 0.003%. When Co content exceeds 2.00%, the rolling surface sustains spalling. Co content is therefore preferably 0.003 to 2.00%.

Cu: 0.01 to 1.00%

Cu improves pearlite structure hardness (strength). Cu is ineffective at a content of less than 0.01%. When Cu content exceeds 1.00%, martensite structure harmful to wear resistance occurs. Cu content is therefore preferably 0.01 to 1.00%.

Ni: 0.01 to 1.00%

Ni ensures high hardness (high strength) of pearlitic steel. When Ni content is less than 0.01%, its effect is minute. When Ni content exceeds 1.00%, the rolling surface sustains spalling. Ni content is therefore preferably 0.01 to 1.00%.

Ti: 0.0050 to 0.0500%

Ti forms nitrides and carbonitrides, thereby improving ductility, and also effectively improves hardness (strength). In addition, it stabilizes unrecrystallized austenite structure by raising the austenite unrecrystallization temperature range. The effect of Ti is slight at a content of less than 0.0050%. When Ti content exceeds 0.0500%, rail ductility markedly decreases owing to occurrence of coarse precipitants. Ti content is therefore preferably 0.0050 to 0.0500%.

Mg: 0.0005 to 0.0200%

Mg effectively improves pearlite structure ductility by refining austenite grains and pearlite structure. The effect of Mg is weak at a content of less than 0.0005%. When Mg content exceeds 0.0200%, rail ductility is reduced owing to occurrence of coarse Mg oxides. Mg content is therefore preferably 0.0005 to 0.0200%.

Ca: 0.0005 to 0.0150%

Ca promotes pearlite transformation and is therefore effective for improving pearlite structure ductility. The effect of Ca is weak at a content of less than 0.0005%. When Ca content exceeds 0.0150%, rail ductility is reduced owing to occurrence of coarse Ca oxides. Ca content is therefore preferably 0.0005 to 0.0150%.

Al: 0.010 to 1.00%

Al is effective for attaining pearlite structure of high strength and inhibiting generation of pro-eutectoid cementite structure. The effect of Al is weak at a content of less than 0.010%. When Al content exceeds 1.00%, rail ductility is reduced owing to occurrence of coarse alumina inclusions. Al content is therefore preferably 0.010 to 1.00%.

Zr: 0.0001 to 0.2000%

Zr suppresses generation of pro-eutectoid cementite structure at segregation regions. When Zr content is less than 0.0001%, pro-eutectoid cementite structure occurs to lower rail ductility. When Zr content exceeds 0.2000%, rail ductility is reduced by abundant occurrence of coarse Zr-type inclusions. Zr content is therefore preferably 0.0001 to 0.2000%.

N: 0.0060 to 0.200%

N increases pearlite structure ductility, while also effectively improving hardness (strength). The effect of N is weak at a content of less than 0.0060%. When N content exceeds 0.0200%, it is difficult to put into solid solution in the steel and forms bubbles that act as starting points of fatigue damage. N content is therefore preferably 0.0060 to 0.0200%. The rail steel contains N as an impurity at a maximum content of around 0.0050%. Intentional addition of N is therefore required to bring N content into the foregoing range.

In the present invention, the steel bloom for rail rolling having the foregoing composition is produced with a commonly used melting furnace such as a converter or electric furnace and the molten steel is cast as ingot or continuously cast.

(2) Reason for Defining Hot Rolling Temperature Range

The reason for limiting the hot rolling temperature of the rail head surface in finish hot rolling to within the range set out in the claims will be explained in detail. It should be noted that the steel bloom for rail rolling is subjected to rough hot rolling and intermediate hot rolling before conducting finish hot rolling.

When hot rolling is conducted with the rail head surface at a temperature higher than 900° C., the reaction force ratio required during hot rolling cannot be achieved under the cumulative reduction of area of the head according to the present invention. This makes it impossible to obtain an adequate amount of unrecrystallized austenite structure, so that the pearlite structure after hot rolling and heat treatment is not refined and ductility therefore does not improve. Moreover, when hot rolling is performed in the temperature range lower than the $Ar_3$ transformation point or $Ar_{cm}$ transformation point, ferrite structure and/or coarse cementite structure forms around the unrecrystallized austenite structure, so that the wear resistance and ductility of the rail are markedly reduced. The range of the hot rolling temperature of the rail head surface is therefore defined as not higher than 900° C. to not lower than $Ar_3$ transformation point or $Ar_{cm}$ transformation point.

At a finish hot rolling temperature below 850° C., the required reaction force ratio can be achieved particularly easily to obtain an adequate amount of unrecrystallized austenite structure, refine the post-rolling and heat treatment pearlite structure and further improve rail ductility. The finish hot rolling temperature is therefore preferably controlled to lower than 850° C. to not lower than $Ar_3$ transformation point or $Ar_{cm}$ transformation point.

The $Ar_3$ transformation point and Arm transformation point vary with the steel carbon content and alloy composition. The best way to determine the $Ar_3$ transformation point and $Ar_{cm}$ transformation point is by direct measurement in a reheating and cooling test or the like. However, such direct measurement is not easy and it suffices to adopt the simpler method of reading the transition points from an Fe—$Fe_3C$ equilibrium diagram such as shown in Tekko Zairo (Iron and Steel Materials) published by the Japan Institute of Metals based solely on carbon content. FIG. 1 shows an example of an Fe—$Fe_3C$ equilibrium diagram.

The $Ar_3$ transformation point and $Ar_{cm}$ transformation point in the composition system of this invention are preferably made values 20 to 30° C. below the $A_3$ line and $Ar_{cm}$ line of the equilibrium diagram. In the carbon content range of this invention, $Ar_3$ is in the range of about 700° C. to 740° C. and $Ar_{cm}$ is in the range of about 700° C. to 860° C.

(3) Reason for Defining Cumulative Reduction of Area of Rail Head

The reason for limiting the cumulative reduction of area of the finish hot rolled rail head to within the ranges set out in the claims will be explained in detail.

When the cumulative reduction of area of the rail head is less than 20%, the amount of strain in the unrecrystallized austenite structure declines, so that the austenite structure after recrystallization is not refined within the hot rolling temperature range of the invention. The austenite structure is therefore coarse. Moreover, pearlite structure does not form from the deformation band of the processed unrecrystallized austenite structure. As a result, the pearlite structure is coarse and rail ductility does not improve. The cumulative reduction of area of the rail head is therefore defined as 20% or greater.

The cumulative reduction of area of the rail head will be explained.

The cumulative reduction of area is the ratio by which the area of the rail head cross-section after the final rolling pass is reduced relative to that before the first rolling pass in finish hot rolling. So irrespective of what rolling pass or passes are conducted in the course of the finish hot rolling, the cumulative reduction of area is the same for the same combination of head cross-section shapes at the first and final hot rolling passes.

Although no particular upper limit is set on the cumulative reduction of area of the finish hot rolled rail head, the practical upper limit from the viewpoint of ensuring rail head formability and dimensional accuracy is about 50%.

Although the invention places no particular limit on the number of rolling passes or the interpass interval during finish hot rolling, from the viewpoint of controlling strain recovery of the unrecrystallized austenite grains in the course of hot rolling and of obtaining fine pearlite structure after spontaneous cooling and heat treatment, the number of rolling passes is preferably 4 or less and the maximum interval between rolling passes is preferably 6 sec or less.

(4) Reason for Defining Reaction Force Ratio During Finish Hot Rolling

The reason for limiting the reaction force ratio during finish hot rolling to within the range set out in the claims will be explained in detail.

When the reaction force ratio during finish hot rolling is less than 1.25, an adequate amount of unrecrystallized austenite structure is not obtained, the pearlite structure after heat treatment is not refined, and ductility does not improve. The reaction force ratio during finish hot rolling is therefore defined as not less than 1.25.

FIG. 2 summarizes the results of a hot rolling test using steels containing 0.65 to 1.20% carbon. As shown in FIG. 2, the relationship between the value obtained by dividing rolling mill reaction force by rolling reaction force at the same cumulative reduction of area and a rolling temperature of 950° C., i.e., the reaction force ratio, and the residual ratio of unrecrystallized austenite structure immediately after rolling is linear, and when the reaction force ratio exceeds 1.25, the residual ratio of unrecrystallized austenite structure immediately after hot rolling exceeds 30%. As a result, the pearlite structure after heat treatment is refined and ductility improves.

The reaction force ratio can therefore be used as a new parameter for controlling the residual ratio of unrecrystallized austenite structure so as to refine the pearlite structure after heat treatment. It is worth noting that the residual ratio of unrecrystallized austenite can be brought to 50% and higher by raising the reaction force ratio to 1.40 and above. This effect is particularly pronounced in high-carbon steels, namely steels having carbon content of 0.95% or higher, in which ductility is hard to achieve because grain growth occurs readily at high carbon content.

The reaction force ratio control in this invention is preferably implemented using a load detector (load cell) or the like installed in the rolling mill. In an actual production process, the average value of the reaction force ratio is preferably controlled as a representative value because reaction force varies in the longitudinal direction of the rail during rail rolling.

Although no upper limit is set on the reaction force ratio, the practical upper limit in the invention hot rolling temperature and rail head cumulative reduction of area ranges is around 1.60.

Although no particular lower limit is set on the residual ratio of unrecrystallized austenite, a rail head residual ratio of 30% or greater is preferably established in order to improve the ductility of the rail head by controlling the reaction force ratio. Excellent ductility can be ensured by establishing a residual ratio of unrecrystallized austenite structure of 50% or greater. Therefore, in the case of a high-carbon steel of a carbon content of 0.95% or greater, in which good ductility is hard to achieve, it is preferable to establish a residual ratio of unrecrystallized austenite structure of 50% or greater. Although no particular upper limit is set on the residual ratio of unrecrystallized austenite structure, the practical upper limit in the invention temperature and reduction of area ranges is about 70%.

The amount of generated unrecrystallized austenite structure immediately after hot rolling can be ascertained by quenching a short rail cut from the long rail immediately after rail rolling. It is possible to check the austenite structure by, for example, cutting a sample from the quenched rail head, polishing the sample, and then etching it with a mixture of sulfonic acid and picric acid. Unrecrystallized austenite structure can be distinguished with a optical microscope because it is coarser and flatter in the rolling direction than recrystallized austenite structure.

The residual ratio of unrecrystallized austenite structure can be calculated by fitting the recrystallized austenite structure to an ellipse, determining the area, and calculating the ratio from its proportion of the field area. Although the details of the measurement method are not particularly specified, 5 or more fields are preferably observed at a magnification of 100× or greater.

If, for instance, the residual ratio of unrecrystallized austenite structure in the rail head immediately after hot rolling completion is measured at a depth of 6 mm from the surface of the rail head 1 (see FIG. 3), the result can be adopted as typical of the overall rail head surface.

(5) Reason for Defining Post-Finish Hot Rolling Heat Treatment Conditions

A detailed explanation of the reason for specifying heat treatment conditions of the post-finish hot rolled rail head surface will be given first.

Although the cooling method up to the start of accelerated cooling is not specified, spontaneous cooling or gradual cooling is preferable. This is because spontaneous cooling or gradual cooling conducted after hot rolling refines the unrecrystallized austenite structure immediately after hot rolling, thereby promoting austenite grain refinement. The spontaneous cooling after hot rolling referred to here means cooling allowed to proceed spontaneously in ambient air without any heating or cooling treatment whatsoever. Gradual cooling means cooling at a cooling rate of 2° C./sec or slower.

Explanation will next be made regarding why the heat treatment conditions set out in the claims enable consistent improvement of ductility by using fine austenite grains obtained from unrecrystallized austenite structure remaining after hot rolling.

The time from completion of finish hot rolling to the start of accelerated cooling is preferably not longer than 150 sec. When accelerated cooling is started after more than 150 sec, grain growth is pronounced. The austenite structure recrystallized from the unrecrystallized austenite structure therefore coarsens, making it impossible to obtain fine austenite structure. Ductility may decline as a result. The time for starting accelerated cooling is therefore preferably defined as falling within 150 sec after finish hot rolling.

Although no lower limit is set on the time interval between completion of finish hot rolling and start of accelerated cooling, it is preferable for thorough generation of fine pearlite structure from inside the unrecrystallized austenite structure to conduct accelerated cooling immediately after rolling so as to avoid rolling strain recovery. The practical lower limit is therefore about 0 to 10 sec after hot rolling completion.

The range of the rate of accelerated cooling of the rail head surface will be explained next. Under the production conditions of the present invention, no ductility improvement is obtained at an accelerated cooling rate of less than 2° C./sec because the recrystallized austenite structure coarsens during the cooling. In addition, high hardness of the rail head cannot be achieved, so that it is difficult to ensure good wear resistance of the rail head. Moreover, depending on the steel composition, pro-eutectoid cementite structure and/or pro-eutectoid ferrite structure may occur to lower the wear resistance and ductility of the rail head. When the accelerated cooling rate exceeds 30° C./sec, the ductility and toughness of the rail head decrease markedly under the invention production conditions owing to the occurrence of martensite structure. The range of the rate of accelerated cooling of the rail head surface is therefore defined as 2 to 30° C./sec.

Finally, the range of the accelerated cooling temperature of the rail head surface will be explained. When the accelerated cooling of the rail head is terminated at a temperature above 550° C., a large amount of recuperative heat from inside the rail raises the temperature after accelerated cooling termination, thereby increasing the pearlite transformation temperature. As a result, required wear resistance cannot be attained because the pearlite structure cannot be hardened to a high degree. In addition, the pearlite structure coarsens, so that the ductility of the rail head also declines. The accelerated cooling is therefore defined as being conducted to at least 550° C.

Although the temperature from which the accelerated cooling of the rail head surface is started is not particularly specified, the practical lower limit of the starting temperature is the $Ar_3$ transformation point or $Ar_{cm}$ transformation point, because of the desirability of inhibiting occurrence of ferrite structure harmful to wear resistance and coarse cementite structure harmful to toughness.

Although the lower limit is not particularly specified for the temperature at which the accelerated cooling of the rail head is terminated, the practical lower limit is 400° C. from the viewpoint of ensuring rail head hardness and preventing occurrence of martensite structure that readily occurs at segregation regions and the like inside the rail head.

The regions of the rail will be explained.

Figure 3:
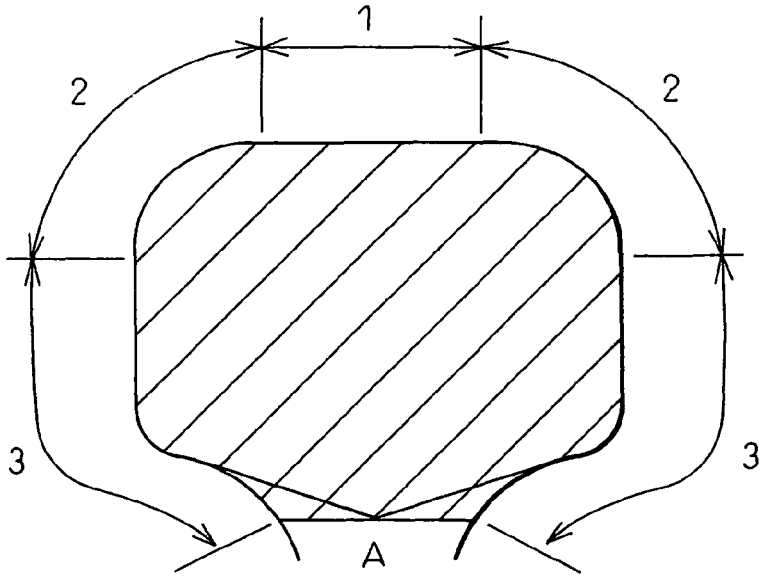
FIG. 3 shows the designations assigned to head cross-sectional surface regions of a rail produced by the rail production method of the present invention.

FIG. 3 shows the designations assigned to regions of the rail. As shown in FIG. 3, the rail head according to the present invention has a portion located above a horizontal line passing through a point A where extensions of the undersurfaces of head sides 3 intersect, which portion includes a rail-head top 1, head corners 2 and the head sides 3. The reduction of area during hot rolling can be calculated from the rate of reduction of the cross-sectional area of the hatched region. As regards the temperature of the rail head surface during hot rolling, it is possible by controlling the temperature of the head surface at the rail-head top 1 and head corners 2 to control the reaction force ratio during hot rolling and thus achieve unrecrystallized austenite grain control to improve rail ductility.

The accelerated cooling rate and accelerated cooling termination temperature in the post-rolling heat treatment explained in the foregoing can be measured at the surface or within a depth range of 3 mm under the surface of the rail-head top 1 and head corners 2 shown in FIG. 3 to obtain temperatures typical of the rail head as a whole, and a fine pearlite structure excellent in wear resistance and ductility can be obtained by controlling the temperatures of these regions and the cooling rate.

Although this invention does not particularly specify the cooling medium used for the accelerated cooling, it is preferable, from the viewpoint of ensuring a predetermined cooling rate for reliably controlling the cooling condition at the respective rail regions, to conduct the predetermined cooling at the outer surface of the rail regions using air, mist, or a mixed medium of air and mist.

Although this invention does not particularly define the hardness of the rail head, a hardness of Hv 350 or greater is preferably established to ensure the wear resistance required for use in a heavy haul railway.

Although the metallographic structure of the steel rail produced in accordance with this invention is preferably pearlite, slight amounts of pro-eutectoid ferrite structure, pro-eutectoid cementite structure and bainite structure may be formed in the pearlite structure depending on the selected component system and the accelerated cooling conditions. However, the occurrence of small amounts of these structures in the pearlite structure has no major effect on the fatigue strength and toughness of the rail. The metallographic structure of the head of the steel rail produced in accordance with this invention is therefore defined to include cases in which some amount of pro-eutectoid ferrite structure, pro-eutectoid cementite structure, and bainite structure are also present.

EXAMPLES

Examples of the present invention are explained in the following.

Figure 4:
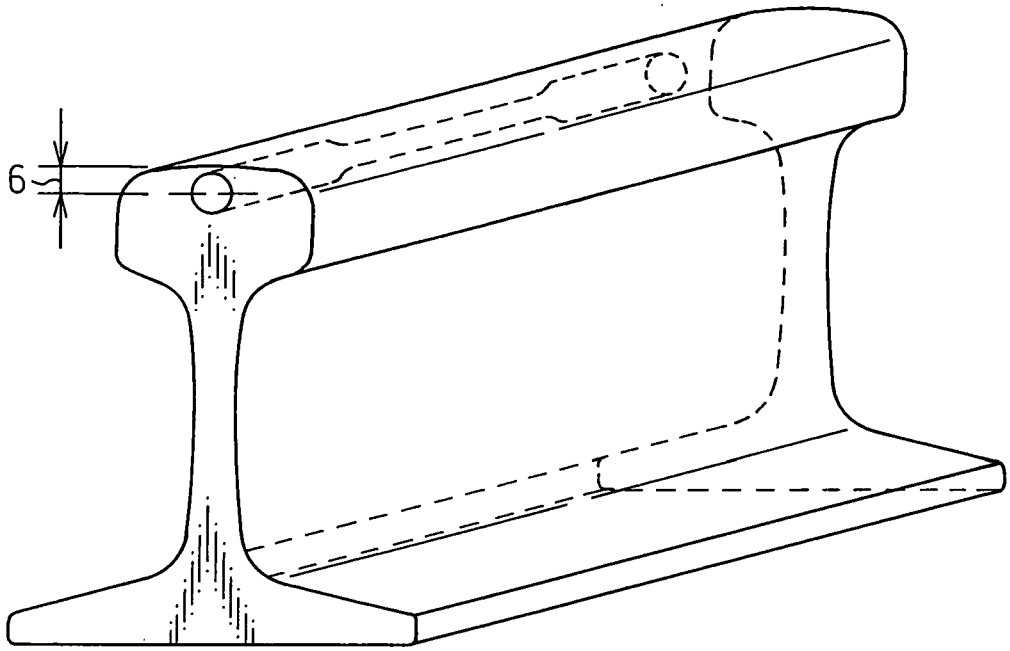
FIG. 4 shows the location from which test specimens were taken in conducting the tensile tests shown in Tables 3 and 5.
Figure 5:
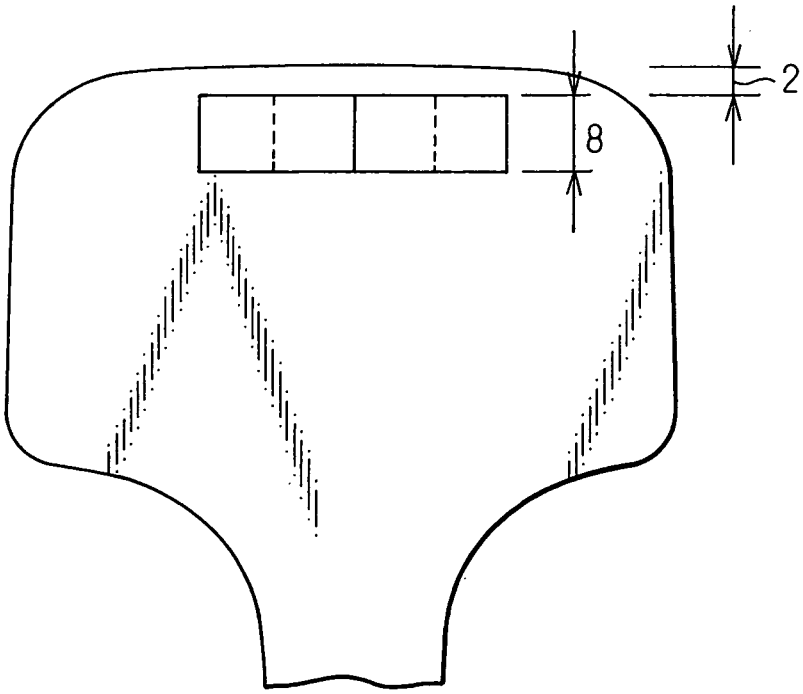
FIG. 5 shows the location from which test specimens were taken in conducting the wear tests shown in Tables 3 and 5.
Figure 6:
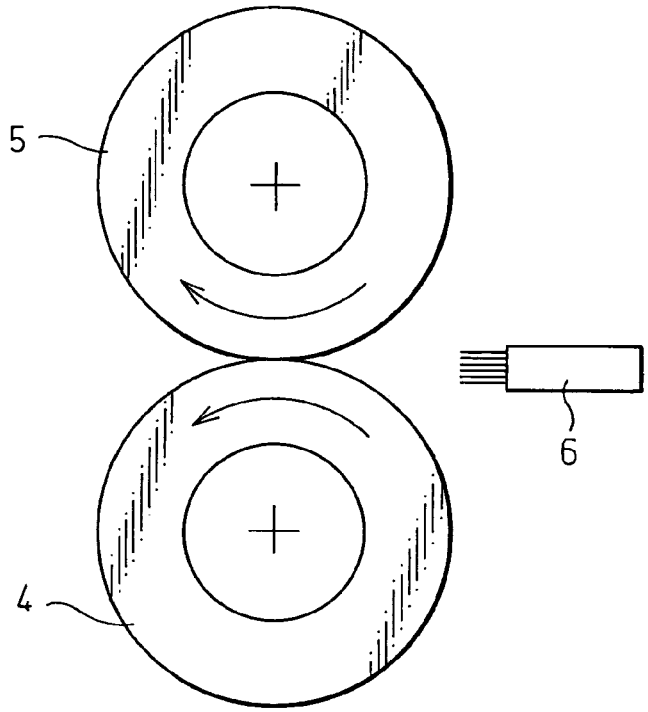
FIG. 6 is an overview of the wear testing.

The chemical compositions of test rail steels are shown in Table 1. Table 2 shows the finish hot rolling conditions, reaction force ratios, head residual ratios of unrecrystallized austenite structure immediately after hot rolling, and heat treatment conditions when using the test steels shown in Table 1 (Steels: A to J, O and P) to carry out production by the invention rail production method. Table 3 shows the microstructures and hardnesses at 2 mm under the rail head surface of the rails produced under the conditions of Table 2, the total elongations in tensile testing of test pieces thereof taken at the location shown in FIG. 4, and the results of wear testing conducted by the method shown in FIG. 6 on test pieces thereof taken at the location shown in FIG. 5. The numerical values in FIGS. 4 and 5 are expressed in millimeters (mm) In FIG. 6, the reference numerals 4, 5 and 6 designate a rail test piece, a counterpart material and a cooling nozzle, respectively.

TABLE 1

| | Chemical composition (mass %) | | | | | |
|---|---|---|---|---|---|---|
| Steel | C | Si | Mn | Cr/Mo/V/Nb/B/Co/Cu//Ni/Ti/Mg/Ca/Al/Zr/N | $Ar_3$ (° C.) | $Ar_{cm}$ (° C.) |
| A | 0.65 | 0.25 | 1.75 | Cu: 0.30, Ni: 0.15 | 740 | None |
| B | 0.75 | 0.80 | 0.80 | Ti: 0.0150, B: 0.0011, Mo: 0.02 | 710 | None |
| C | 0.85 | 0.60 | 0.85 | Co: 0.14 | None | 710 |
| D | 0.90 | 0.50 | 1.05 | Nb: 0.01 | None | 750 |
| E | 0.90 | 0.10 | 1.05 | Cr: 0.21 | None | 760 |
| O | 0.95 | 0.40 | 0.80 | | None | 770 |
| P | 0.95 | 0.80 | 0.80 | Cr: 0.50 | None | 770 |
| F | 1.00 | 0.50 | 0.85 | | None | 790 |
| G | 1.00 | 0.50 | 0.70 | Cr: 0.25, V: 0.02, N: 0.0080 | None | 790 |
| H | 1.10 | 1.25 | 0.50 | | None | 810 |
| I | 1.10 | 0.70 | 0.70 | Mg: 0.0010, Ca: 0.0015 | None | 810 |
| J | 1.20 | 1.85 | 0.10 | Al: 0.05, Zr: 0.0010 | None | 860 |
| K | 0.50 | 0.25 | 1.75 | Cu: 0.30, Ni: 0.15 | 780 | None |
| L | 1.10 | 2.25 | 0.50 | | None | 830 |
| M | 0.90 | 0.50 | 2.35 | Nb: 0.01 | None | 750 |
| N | 1.35 | 1.85 | 0.10 | Al: 0.05, Zr: 0.0010 | None | 920 |

Remark: Balance of unavoidable impurities and Fe

TABLE 2

| | | | Finish hot rolling conditions | | | | Head residual | Heat treatment conditions | | | |
|---|---|---|---|---|---|---|---|---|---|---|---|
| Production method | No. | Steel | Hot Rolling Temp (° C.) | Head cumulative reduction of area (%) | Reaction force ratio | Other rolling conditions | ratio of unrecrystallized austenite structure just after rolling (%) | Cooling method from end rolling to start heat treatment | Time from end rolling to start heat treatment (sec) | Accelerated cooling rate (° C./sec) | Cooling termination temp (° C./sec) |
| Invention production method | 1 | A | 850 | 35 | 1.35 | Rolling passes: 2 Max pass interval: 6 s | 40 | Spontaneous | | | |
| | 2 | B | 720 | 25 | 1.50 | Rolling passes: 4 Max pass interval: 3 s | 60 | Spontaneous | 140 | 2 | 540 |
| | 3 | B | 850 | 25 | 1.25 | Rolling passes: 4 Max pass interval: 3 s | 30 | Spontaneous | 140 | 2 | 540 |

TABLE 2-continued

| Production method | No. | Steel | Finish hot rolling conditions: Hot Rolling Temp (° C.) | Head cumulative reduction of area (%) | Reaction force ratio | Other rolling conditions | Head residual ratio of unrecrystallized austenite structure just after rolling (%) | Heat treatment conditions: Cooling method from end rolling to start heat treatment | Time from end rolling to start heat treatment (sec) | Accelerated cooling rate (° C./sec) | Cooling termination temp (° C./sec) |
|---|---|---|---|---|---|---|---|---|---|---|---|
| | 4 | C | 800 | 30 | 1.35 | Rolling passes: 3<br>Max pass interval: 3 s | 40 | Spontaneous | | | |
| | 5 | C | 800 | 30 | 1.34 | Rolling passes: 3<br>Max pass interval: 3 s | 40 | Spontaneous | 100 | 5 | 520 |
| | 6 | C | 800 | 50 | 1.39 | Rolling passes: 3<br>Max pass interval: 3 s | 50 | Spontaneous | 100 | 5 | 520 |
| | 7 | D | 900 | 20 | 1.30 | Rolling passes: 4<br>Max pass interval: 4 s | 35 | Spontaneous | 70 | 6 | 500 |
| | 8 | D | 900 | 20 | 1.40 | Rolling passes: 4<br>Max pass interval: 1 s | 50 | Spontaneous | 70 | 6 | 500 |
| | 9 | E | 850 | 30 | 1.41 | Rolling passes: 3<br>Max pass interval: 5 s | 50 | Gradual<br>1.5° C./sec | 5 | 8 | 480 |
| | 10 | E | 850 | 30 | 1.40 | Rolling passes: 3<br>Max pass interval: 5 s | 50 | Gradual<br>1.5° C./sec | 60 | 8 | 480 |
| | 11 | E | 850 | 30 | 1.42 | Rolling passes: 3<br>Max pass interval: 5 s | 50 | Gradual<br>1.5° C./sec | 120 | 8 | 480 |
| | 35 | O | 850 | 30 | 1.35 | Rolling passes: 3<br>Max pass interval: 2 s | 45 | Spontaneous | 50 | 7 | 500 |
| | 36 | O | 850 | 40 | 1.43 | Rolling passes: 3<br>Max pass interval: 2 s | 55 | Spontaneous | 50 | 7 | 500 |
| | 37 | P | 825 | 35 | 1.55 | Rolling passes: 3<br>Max pass interval: 3 s | 65 | Spontaneous | 10 | 15 | 480 |
| | 12 | F | 840 | 30 | 1.35 | Rolling passes: 1 | 45 | Spontaneous | | | |
| | 13 | F | 840 | 30 | 1.34 | Rolling passes: 1 | 45 | Spontaneous | 8 | 10 | 420 |
| | 14 | G | 800 | 50 | 1.55 | Rolling passes: 2<br>Max pass interval: 4 s | 65 | Spontaneous | 1 | 15 | 520 |
| | 15 | H | 830 | 30 | 1.50 | Rolling passes: 1 | 60 | Spontaneous | 30 | 15 | 500 |
| | 16 | H | 830 | 30 | 1.40 | Rolling passes: 2<br>Max pass interval: 1 s | 50 | Spontaneous | 30 | 15 | 500 |
| | 17 | H | 830 | 30 | 1.35 | Rolling passes: 4<br>Max pass interval: 1 s | 40 | Spontaneous | 30 | 15 | 500 |
| | 18 | I | 820 | 40 | 1.45 | Rolling passes: 2<br>Max pass interval: 4 s | 55 | Spontaneous | 20 | 20 | 520 |
| | 38 | I | 820 | 45 | 1.60 | Rolling passes: 2<br>Max pass interval: 4 s | 70 | Spontaneous | 20 | 20 | 520 |
| | 19 | J | 870 | 35 | 1.34 | Rolling passes: 3<br>Max pass interval: 2 s | 40 | Gradual<br>0.5° C./sec | 5 | 30 | 540 |
| | 39 | J | 870 | 45 | 1.50 | Rolling passes: 3<br>Max pass interval: 2 s | 60 | Gradual<br>0.5° C./sec | 5 | 30 | 540 |

TABLE 3

| Production method | No. | Steel | Rail properties: Head microstructure (2 mm under surface) | Head hardness (2 mm under surface) (Hv 10 kgf) | Tensile test result *1 Total elongation (%) | Wear test result *2 Wear (g, 700K times) |
|---|---|---|---|---|---|---|
| Invention production method | 1 | A | Pearlite | 350 | 21.0 | 1.32 |
| | 2 | B | Pearlite | 370 | 17.0 | 1.10 |
| | 3 | B | Pearlite | 370 | 15.2 | 1.12 |
| | 4 | C | Pearlite | 360 | 13.0 | 1.18 |
| | 5 | C | Pearlite | 390 | 14.5 | 1.08 |
| | 6 | C | Pearlite | 390 | 15.5 | 1.07 |
| | 7 | D | Pearlite | 445 | 14.0 | 0.98 |
| | 8 | D | Pearlite | 445 | 14.8 | 0.94 |
| | 9 | E | Pearlite | 430 | 15.5 | 0.96 |
| | 10 | E | Pearlite | 430 | 14.8 | 0.92 |
| | 11 | E | Pearlite | 430 | 14.5 | 0.95 |
| | 35 | O | Pearlite | 420 | 12.0 | 0.73 |
| | 36 | O | Pearlite | 420 | 13.0 | 0.71 |
| | 37 | P | Pearlite | 460 | 13.0 | 0.67 |
| | 12 | F | Pearlite | 360 | 11.5 | 0.71 |
| | 13 | F | Pearlite | 440 | 13.2 | 0.58 |
| | 14 | G | Pearlite | 480 | 13.5 | 0.51 |

TABLE 3-continued

| Production method | No. | Steel | Rail properties: Head microstructure (2 mm under surface) | Head hardness (2 mm under surface) (Hv 10 kgf) | Tensile test result *1 Total elongation (%) | Wear test result *2 Wear (g, 700K times) |
|---|---|---|---|---|---|---|
| | 15 | H | Pearlite | 450 | 12.5 | 0.45 |
| | 16 | H | Pearlite | 450 | 12.0 | 0.41 |
| | 17 | H | Pearlite | 450 | 11.6 | 0.43 |
| | 18 | I | Pearlite | 485 | 11.0 | 0.35 |
| | 38 | I | Pearlite | 485 | 12.0 | 0.34 |
| | 19 | J | Pearlite | 470 | 10.2 | 0.30 |
| | 39 | J | Pearlite | 470 | 10.8 | 0.28 |

*1: Tensile test piece taken from location shown in FIG. 4.

*2: Test by method of FIG. 6 using test piece taken from location shown in FIG. 5.

Table 4 shows the finish hot rolling conditions, reaction force ratios, head residual ratios of unrecrystallized austenite structure immediately after hot rolling, and heat treatment conditions when using the test steels shown in Table 1 (Steels: B to N,) to carry out production by the invention rail production method and comparative rail production methods. Table 5 shows the microstructures and hardnesses at 2 mm under the rail head surface of the rails produced under the conditions of Table 4, the total elongations in tensile testing of test pieces thereof taken at the location shown in FIG. 4, and the results of wear testing conducted by the method shown in FIG. 6 on test pieces thereof taken at the location shown in FIG. 5.

TABLE 4

| Production method | No. | Steel | Finish hot rolling conditions: Hot Rolling Temp (° C.) | Head cumulative reduction of area (%) | Reaction force ratio | Other rolling conditions | Head residual: ratio of unrecrystallized austenite structure just after rolling (%) | Heat treatment conditions: Cooling method from end rolling to start heat treatment | Time from end rolling to start heat treatment (sec) | Accelerated cooling rate (° C./sec) | Cooling termination temp (° C./sec) |
|---|---|---|---|---|---|---|---|---|---|---|---|
| Comparative rail production method | 20 | K | 800 | 25 | 1.33 | Rolling passes: 3<br>Max pass interval: 3 s | 40 | Spontaneous | 130 | 6 | 520 |
| | 21 | N | 930 | 35 | 1.30 | Rolling passes: 3<br>Max pass interval: 3 s | 35 | Gradual 0.5° C./sec | 60 | 10 | 550 |
| | 22 | L | 830 | 30 | 1.48 | Rolling passes: 1<br>Max pass interval: 1 s | 60 | Spontaneous | 30 | 15 | 500 |
| | 23 | M | 900 | 20 | 1.30 | Rolling passes: 4<br>Max pass interval: 4 s | 35 | Spontaneous | 70 | 6 | 500 |
| | 24 | B | 650 (<Ar3 point) | 25 | 1.35 | Rolling passes: 4<br>Max pass interval: 3 s | 45 | Spontaneous | 140 | 3 | 540 |
| | 25 | J | 800 (<Arcm point) | 35 | 1.25 | Rolling passes: 3<br>Max pass interval: 2 s | 30 | Gradual 0.5° C./sec | 5 | 25 | 540 |
| | 26 | E | 950 | 30 | 1.00 | Rolling passes: 3<br>Max pass interval: 5 s | 0 | Gradual 1.5° C./sec | 60 | 8 | 480 |
| | 27 | H | 920 | 30 | 1.15 | Rolling passes: 1<br>Max pass interval: 1 s | 15 | Spontaneous | 30 | 15 | 500 |
| | 28 | D | 900 | 10 | 1.28 | Rolling passes: 4<br>Max pass interval: 4 s | 35 | Spontaneous | 70 | 6 | 500 |
| | 29 | F | 840 | 5 | 1.10 | Rolling passes: 1 | 10 | Spontaneous | 8 | 6 | 420 |
| Invention rail production method | 30 | B | 720 | 25 | 1.58 | Rolling passes: 4<br>Max pass interval: 3 s | 60 | Spontaneous | 200 | 3 | 540 |
| | 31 | E | 850 | 30 | 1.40 | Rolling passes: 3<br>Max pass interval: 5 s | 50 | Gradual 1.5° C./sec | 180 | 8 | 480 |
| Comparative rail production method | 32 | I | 820 | 40 | 1.45 | Rolling passes: 2<br>Max pass interval: 4 s | 55 | Spontaneous | 20 | 1 | 520 |
| | 33 | C | 800 | 30 | 1.32 | Rolling passes: 3<br>Max pass interval: 3 s | 40 | Spontaneous | 100 | 35 | 520 |
| | 34 | G | 800 | 50 | 1.55 | Rolling passes: 2<br>Max pass interval: 4 s | 65 | Spontaneous | 1 | 15 | 600 |

TABLE 5

| Production method | No. | Steel | Rail properties: Head microstructure (2 mm under surface) | Head hardness (2 mm under surface) (Hv 10 kgf) | Tensile test result *1 Total elongation (%) | Wear test result *2 Wear (g, 700K times) |
|---|---|---|---|---|---|---|
| Comparative rail production method | 20 | K | Pearlite + pro-eutectoid ferrite | 325 | 20.0 | 1.85 (Irregular structure High wear) |
| | 21 | N | Pearlite + pro-eutectoid cementite | 450 | 6.5 (Irregular structure Poor elongation) | 0.45 |
| | 22 | L | Pearlite + martensite | 620 | 4.5 (Irregular structure Poor elongation) | 2.25 (Irregular structure High wear) |
| | 23 | M | Pearlite + martensite | 580 | 5.0 (Irregular structure Poor elongation) | 2.15 (Irregular structure High wear) |
| | 24 | B | Pearlite + pro-eutectoid ferrite | 330 | 18.0 | 1.80 (Irregular structure High wear) |
| | 25 | J | Pearlite + pro-eutectoid cementite | 470 | 6.0 (Irregular structure Poor elongation) | 0.60 |
| | 26 | E | Coarse pearlite | 430 | 11.0 (Pearlite coarsening Poor elongation) | 0.85 |
| | 27 | H | Coarse pearlite | 450 | 7.5 (Pearlite coarsening Poor elongation) | 0.44 |
| | 28 | D | Coarse pearlite | 445 | 10.0 (Pearlite coarsening Poor elongation) | 0.80 |
| | 29 | F | Coarse pearlite | 440 | 9.5 (Pearlite coarsening Poor elongation) | 0.59 |
| Invention rail production method | 30 | B | Pearlite | 370 | 13.0 | 1.09 |
| | 31 | E | Pearlite | 430 | 12.0 | 0.85 |
| Comparative rail production method | 32 | I | Pearlite + pro-eutectoid cementite | 360 | 6.5 (Irregular structure Poor elongation) | 0.70 |
| | 33 | C | Pearlite + martensite | 640 | 4.5 (Irregular structure Poor elongation) | 2.30 (Irregular structure High wear) |
| | 34 | G | Coarse pearlite | 370 | 10.0 (Pearlite coarsening Poor elongation) | 0.70 |

*1: Tensile test piece taken from location shown in FIG. 4.
*2: Test by method of FIG. 6 using test piece taken from location shown in FIG. 5.

With regard to the Examples:

(1) The 26 rails designated No. 1 to 19, 30, 31 and 35 to 39 are rails produced by the rail production method of this invention. They use rail steels of compositions falling within the range defined by this invention and are pearlitic rails produced using finish hot rolling and heat treatment conditions falling within the ranges defined by the invention. Note that in the production of rails No. 30 and 31 the times between termination of rolling and start of heat treatment were outside the preferred range.

(2) The 13 rails designated No. 20 to 29 and 32 to 34 are rails produced by comparative methods, as set out below.

Rails No. 20 to 23: Rails produced from rail steels of compositions falling outside the aforesaid range using heat treatment conditions immediately after hot rolling falling within the aforesaid defined range.

Rails No. 24 to 29: Rails produced from rail steels of compositions falling within the aforesaid range using finish hot rolling conditions falling outside the aforesaid defined range.

Rails No. 32 to 34: Rails produced from rail steels of compositions falling within the aforesaid range using heat treatment conditions falling outside the aforesaid defined ranges.

Figure 7:
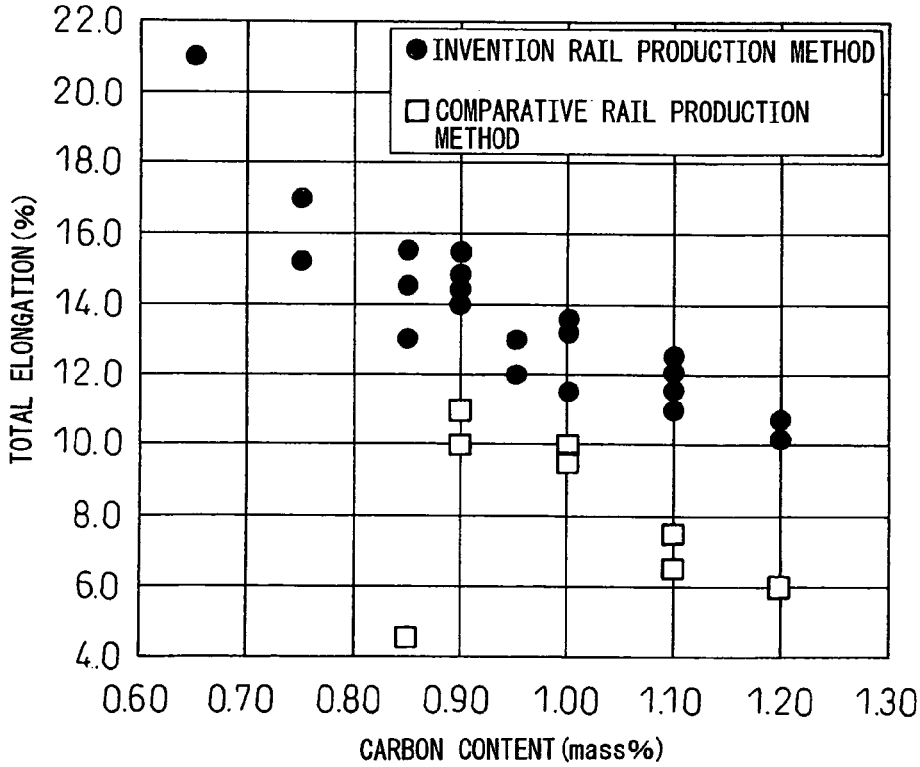
FIG. 7 is a graph showing how total elongation varied as a function of carbon content in head tensile tests conducted on the rails shown in Tables 2 and 3 produced by the rail production method of the present invention and the rails shown in Tables 4 and 5 produced by comparative production methods.
Figure 8:
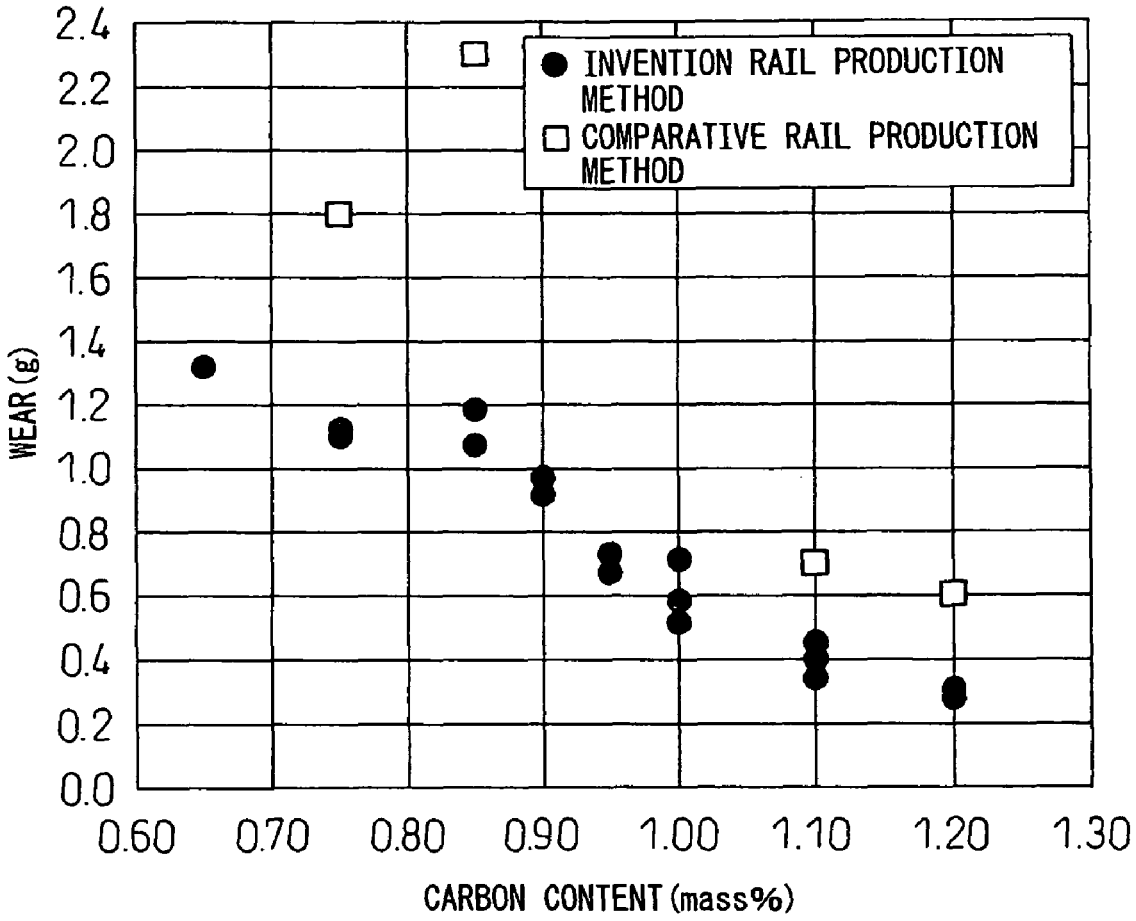
FIG. 8 is a graph showing how wear varied as a function of carbon content in head wear tests conducted on the rails shown in Tables 2 and 3 produced by the rail production method of the present invention and the rails shown in Tables 4 and 5 produced by comparative production methods.

FIG. 7 shows how in the rail head tensile testing the total elongation was found to vary with carbon content in the rails shown in Tables 2 and 3 produced by the invention rail production method (invention rails) and in the rails shown in Tables 4 and 5 produced comparative rail production methods (comparative rails). FIG. 8 shows how in the rail head wear testing the wear was found to vary with carbon content in the rails shown in Tables 2 and 3 produced by the invention rail production method and in the rails shown in Tables 4 and 5 produced by comparative rail production methods.

The test conditions were as follows:

1. Rail Head Tensile Test

Tester: Benchtop universal tensile testing machine

Test piece shape: Similar to JIS No. 4

Parallel section length: 30 mm; Parallel section diameter: 6 mm; Distance between elongation measurement marks: 25 mm Test piece sampling location: 6 mm beneath rail head surface (see FIG. 4)

Tensile strain rate: 10 mm/min; Test temperature: Room temp. (20° C.)

2. Wear Test

Tester: Nishihara wear tester (see FIG. 6)

Test piece shape: Disk-like test piece (Outside diameter: 30 mm; Thickness: 8 mm)

Test piece sampling location: 2 mm beneath rail head surface (see FIG. 5)

Test load: 686 N (Contact surface pressure: 640 MPa)

Slip ratio: 20%

Counterpart material: Pearlitic steel (Hv 380)

Atmosphere: Air

Cooling: Forced cooling with compressed air (Flow rate: 100 Nl/min)

Number of repetitions: 700,000

As shown in Table 3, the invention rails No. 5 and 13 were markedly better in ductility than the invention rails No. 4 and 12 because in addition to being spontaneously cooled, they were within a predetermined time thereafter subjected to accelerated cooling that inhibited coarsening of recrystallized austenite grains.

In the case of the invention rails No. 36, 38 and 39, the reaction force ratio during finish hot rolling was 1.40 or greater, thereby establishing a residual ratio of unrecrystallized austenite structure of 50% or greater. As a result, these rails were greatly improved in ductility even as compared with the invention rails No. 35, 18 and 19.

As shown in Tables 1, 2 and 4, unlike the comparative rails No. 20 to 23, the invention rails No. 1 to 19, 30, 31 and 35 to 39 had C, Si and Mn contents falling within certain prescribed ranges, so that pearlite structure excellent in wear resistance and ductility was formed without formation of pro-eutectoid ferrite, pro-eutectoid cementite structure, martensite structure and the like, which adversely affect rail wear resistance and ductility.

As shown in Tables 2 to 5 and FIG. 7, unlike the comparative rails No. 25 to 29, the invention rails No. 1 to 19 and 35 to 39, were finish hot rolled under conditions falling within the specified ranges, so that fine pearlite structure was stably formed to improve rail head ductility at the same steel carbon content. Moreover, unlike the comparative rails No. 32 to 34, the invention rails No. 1 to 19 and 35 to 39 were heat-treated under conditions falling in the specified ranges, so that fine pearlite structure was stably formed to further improve rail head ductility at the same steel carbon content.

As shown in Tables 2 to 5 and FIG. 8, unlike the comparative rails No. 24 and 25, the invention rails No. 1 to 19 and 35 to 39 were finish hot rolled under conditions falling within the specified ranges, so that fine pearlite structure was stably formed to establish good wear resistance. Moreover, unlike the comparative rails No. 32 and 33, the invention rails No. 1 to 19 and 35 to 39 were heat-treated under conditions falling in the specified ranges, so that occurrence of pro-eutectoid cementite structure and martensite structure harmful to wear resistance was inhibited, thereby ensuring good wear resistance.

INDUSTRIAL APPLICABILITY

In the production of a rail for use in a heavy haul railway, the present invention controls the rail steel composition, finish hot rolling conditions, and subsequent heat treatment conditions to control the structure of the rail head, thereby attaining a hardness within a prescribed range and enabling improvement of rail wear resistance and ductility. The invention therefore provides a rail with high utility in a heavy haul railway.

What is claimed is:

1. A method for producing a pearlitic rail excellent in wear resistance and ductility by subjecting to at least rough hot rolling and finish hot rolling a billet comprising, in mass %, C: 0.65-1.20%, Si: 0.05-2.00%, Mn: 0.05-2.00%, and a remainder of iron and unavoidable impurities, which method comprises:

conducting the finish hot rolling at a rail head surface temperature in a range of not higher than 900° C. to not lower than $Ar_3$ transformation point or $Ar_{cm}$ transformation point to produce a head cumulative reduction of area of not less than 20%, wherein a reaction force ratio of the finish rolling is not less than 1.25, the reaction force ratio defined as a value obtained by dividing a rolling mill reaction force for the cumulative reduction of area, at a temperature not higher than 900° C. to a temperature not lower than $Ar_3$ transformation point or $Ar_{cm}$ transformation point, by a rolling reaction force that provides a head cumulative reduction of area, at a rolling temperature of 950° C., equal to the cumulative reduction of area obtained in the temperature range of not higher than 900° C. to not lower than $Ar_3$ transformation point or $Ar_{cm}$ transformation point; and subjecting the finish hot rolled rail head surface to accelerated cooling or spontaneous cooling to a temperature of 550° C. or less at a cooling rate of 2 to 30° C./seconds.

2. A method for producing a pearlitic rail excellent in wear resistance and ductility according to claim 1, wherein the accelerated cooling is started within 150 seconds after completion of the finish hot rolling.

* * * * *